United States Patent [19]

Ichino et al.

[11] Patent Number: 5,075,189

[45] Date of Patent: Dec. 24, 1991

[54] ELECTROPHOTOGRAPHIC PHOTORECEPTOR COMPRISING AN UNDERCOAT LAYER CONTAINING A POLYAMIDE COPOLYMER

[75] Inventors: Tadasu Ichino, Fussa; Eiichi Sakai, Niiza; Yoshiaki Takei, Hachioji, all of Japan

[73] Assignee: Konica Corporation, Tokyo, Japan

[21] Appl. No.: 638,320

[22] Filed: Jan. 7, 1991

[30] Foreign Application Priority Data

Jan. 9, 1990 [JP] Japan ..... 2-1790

[51] Int. Cl.[5] ..... G03G 5/14

[52] U.S. Cl. ..... 430/59; 430/58; 430/60

[58] Field of Search ..... 430/58, 60, 59

[56] References Cited

U.S. PATENT DOCUMENTS 4,877,701 10/1989 Hiro et al. ..... 430/58

*Primary Examiner*—David Welsh
*Assistant Examiner*—S. Rosasco
*Attorney, Agent, or Firm*—Finnegan, Henderson, Farabow, Garrett, and Dunner

[57] ABSTRACT

An electrophotographic photoreceptor is disclosed. The material comprises a conductive support and, provided thereon, an undercoat layer, a carrier generating layer and a carrier transport layer in this order, wherein said undercoat layer contains an N-alkoxylated polyamide copolymer or N-alkylated polyamide copolymer a unit represented by the following Formula 1:

$$-NH-(CH_2)_{11}-CO-$$ Formula 1.

11 Claims, 1 Drawing Sheet

ELECTROPHOTOGRAPHIC PHOTORECEPTOR COMPRISING AN UNDERCOAT LAYER CONTAINING A POLYAMIDE COPOLYMER

FIELD OF THE INVENTION

The present invention relates to an electrophotographic photoreceptor, and more particularly to the improvements of the charging rise characteristic, durability and image quality thereof.

BACKGROUND OF THE INVENTION

There have lately been a good number of proposals for electrophotographic photoreceptors using organic photoconductive materials in place of conventional inorganic photoconductive materials in order to meet the needs for the recent extension of the market and diversified use of copiers and printers. The organic photoconductive materials can be of diversely different types obtained according to various combinations of substances and synthesis conditions, and therefore widely selective and useful for improving the various characteristics required for the electrophotographic process, such as the charge retainability, surface strength, sensitivity and stability in the repetitive use thereof. An electrophotographic photoreceptor to which an organic photoconductive material is applied has the advantage that it has a high productivity and stability to environmental conditions.

In general, an organic photoconductive photoreceptor comprises a photosensitive layer containing photoconductive organic semiconductors, i.e., a charge (carrier) generating material (hereinafter abbreviated to CGM) and a charge (carrier) transport material (hereinafter abbreviated to CTM).

Further, there has been proposed a photoreceptor of the function separation type of which the photosensitive layer comprises at least two separate layers: one is a carrier generating layer (hereinafter abbreviated to CGL) and the other a carrier transport layer (hereinafter abbreviated to CTL). The separate allotment of the carrier generating function and the carrier transport function to different substances is expected to provide a photoreceptor which enables easy control of its electrophotographic characteristics such as the sensitivity and charging characteristics, and has a high sensitivity and an excellent durability. Particularly in a negatively chargeable photoreceptor, on a conductive support is provided a CGL layer having thereon a CTL layer. The photoreceptor of this type, however, is still not sufficient in the charging characteristics and image quality. That is, in a conventional photoreceptor, when it is charged, leakage current occurs to make the charging rise insufficient so that neither sufficient charging potential for exposure nor sufficient barrier characteristics of the undercoat layer can be obtained to cause fine image defects, which appear as white spots in a regular development or as black spots in reversal development.

Generally, CGL is a very thin layer, e.g., 0.5 $\mu$m in thickness, provided on a conductive support. Even only slight defects, stains, foreign matter or scratches on the surface of the support affect the uniformity of the function of CGL. The function of CGL, if not uniform, causes the photoreceptor to have a sensitivity unevenness. For this reason, it has been proposed that an undercoat layer having both functions as a barrier layer and as an adhesive layer be provided between the CGL and the conductive support.

Known materials usable for the undercoat layer to be provided between the photosensitive layer and the conductive support include polyurethane, polyamide, polyvinyl alcohol, epoxy resin, casein, methyl cellulose, nitrocellulose and phenol resin. However, a photoreceptor having such an undercoat layer, when used repeatedly, causes a rise in the light potential and a drop of the dark potential, and at the same time, a discharge breaking of the photosensitive layer. Particularly a photoreceptor having the conventional undercoat layer, when used repeatedly under a low humidity environment, causes a remarkable rise in the light potential and a conspicuous drop of the dark potential, and thus is unable to provide constant quality image copies repeatedly under unstable environmental conditions, and furthermore, the adhesion property of its photosensitive layer to its support is insufficient.

To cope with the above disadvantage, Japanese Patent Publication Open to Public Inspection (hereinafter referred to as JP O.P.I.) No. 202448/1985 discloses a photoreceptor which uses alcohol-soluble nylon resin for its subbing layer and polyvinyl formal for its CGL, and JP O.P.I No. 18185/1988 discloses a photoreceptor which uses N-alkoxymethylated nylon and/or N-alkylated nylon each having a single monomer for its undercoat layer.

However, even these disclosed techniques are still unable to get rid of the aforementioned disadvantages.

SUMMARY OF THE INVENTION

It is an object of the present invention to provide an electrophotographic photoreceptor which solves the above problems, has excellent charging rise characteristics and stability to environmental conditions when used repeatedly, and produces no black spots in reversal development.

DETAILED DESCRIPTION OF THE INVENTION

Figure 1:
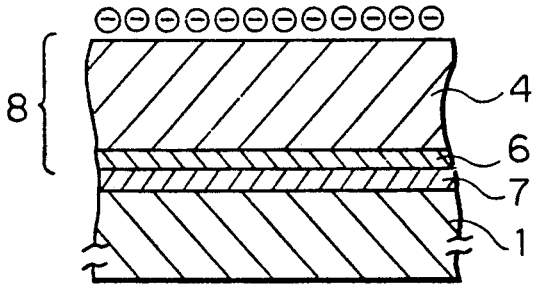
FIGS. 1 through 4 are cross-sectional views of examples of the layer construction of the electrophotographic photoreceptor of the invention.

In general, the molecules of polyamide resin (hereinafter may sometimes be called nylon) produces therebetween a hydrogen bonding due to the coordination of the polar groups NH and CO in the molecular structure to cause the nylon macromolecule to be oriented in a given direction to reveal cellulosic characteristics (crystallinity). However, if the polar group NH of the nylon is N-alkoxylated and/or N-alkylated, then it lowers the melting point and increases the solvent-solubility of the resin.

On the other hand, as compared to a simple mixture of different nylons such as 6-nylon and 66-nylon, the above different nylons' copolymer has its molecules disarrayed and its melting point remarkably lowered to thereby become soluble in hot alcohol and hot water: thus the simple mixture and the copolymer indicate significant difference as if they are quite different resins.

The present invention has been made, paying attention to the above remarkable difference in the characteristics.

The above object of the invention is accomplished by an electrophotographic photoreceptor comprising a conductive support and, provided thereon, an undercoat layer, a carrier generating layer and a carrier transport layer in this order, wherein said undercoat layer contains an N-alkoxylated polyamide copolymer or N-alkylated polyamide copolymer comprising a unit represented by the following Formula I:

$$-NH-(CH_2)_{11}-CO- \qquad \text{Formula 1}$$

Further, as an embodiment of the invention, it is preferable, in the case of a function-separated-type photoreceptor, to incorporate into the CGL layer at least a disazo pigment such as fluorenone or fluorenylidene pigment: a polycyclic quinone pigment: or a metallic or oxytitanyl phthalocyanine pigment as CGM.

The nylon copolymer used in the invention comprises a unit represented by the following Formula 1 in an amount of 20 to 80 mol%, and preferably 30 to 70 mol%.

$$-NH-(CH_2)_{11}-CO- \qquad \text{Formula 1}$$

The N-alkoxylated nylon, which is a monomer of the copolymer nylon used in the invention, is one in which the hydrogen atom in the nylon's amide linkage —NH-CO— is substituted by an alkoxy group such as methoxy, ethoxy or propoxy, and is soluble in methyl alcohol, ethyl alcohol or isopropyl alcohol, highly soluble especially in a lower alcohol. The N-alkoxylated polyamide copolymer of the invention comprises an alkoxy group in an amount of 18 to 50 mol%, and preferably from 30 to 45 mol%, based on the total amount of an amide bond.

The N-alkoxylated nylon can be prepared according to the synthesis methods described in 'Chemical and Ind' Vol.10, p. 985 (1951), 'J. Am. Chem. Soc.' Vol.71, p.651 (1949), and U.S. Pat. No. 2,430,860. For example, to a 6-nylon solution is added a methyl alcohol solution of p-formaldehyde, this mixed solution is poured in a water-acetone mixed solution, and then a concentrated ammonia water is added thereto, whereby N-methoxylated nylon is produced in the form of a deposition. As the N-alkoxylated nylon single resin, there are commercially available 'Toresin F30' and 'Toresin HF30+ manufactured by Teikoku Sangyo Co., Ltd.

The N-alkylated nylon, which is a monomer of the copolymer nylon used in the invention, is one in which the hydrogen atom in the nylon's amide linkage —NH-CO— is substituted by an alkyl group such as methyl, ethyl or propyl, and is highly soluble in methyl alcohol, ethyl alcohol or isopropyl alcohol. The N-alkylated polyamide copolymer of the invention comprises an alkyl group in an amount of 18 to 50 mol%, and preferably from 30 to 45 mol%, based on the total amount of an amide bond. The N-alkylated nylon can be easily obtained by the methods described in 'J. Polymer Sci.', Vol.40, p.339 (1959) or 'Ind. Eng. Chem.', Vol. 51, p. 147 (1959).

The copolymerization of these single nylon monomers can be performed in the usual manner: e.g., under high temperature and high pressure conditions.

The number average molecular weight of these nylons is generally 2000 to 100000, and preferably 10000 to 40000.

The undercoat layer used in the invention can be obtained by coating on a conductive support an alcohol solution containing at least one of the N-alkoxylated nylon and/or N-alkylated nylon copolymers comprising a unit of Formula I described above in accordance with a coating method such as dip coating, roll coating, spray coating, wire-bar coating, bead coating or curtain coating, and the coated thickness is preferably 0.1 to 5μm, and more preferably 0.5 to 3 μm. To the alcohol solution may, for its stabilization, be added tolunne, xylene, etc.

The undercoat layer of the invention may, if necessary, contain, within limits not to impair the function as a barrier layer, other resins including polyamide resins such as 66-nylon and 610-nylon, and vinyl acetate resin: particularly it is preferable to use nylon-6/66/610/12 copolymers in combination. In this instance, the N alkoxylated polyamide copolymer or N-alkylated polyamide copolymer of the invention is contained in the undercoat layer in an amount of 5 to 100%, and preferably 20 to 100% by weight.

In the photoreceptor of the invention, any of the organic pigments listed below may be used as CGM:

(1) Azo pigments such as monoazo pigments, bisazo pigments, triazo pigments and metallic complex salt azo pigments.

(2) Perylene pigments such as perylenic acid anhydride and perylenic acid imide.

(3) Polycyclic quinone pigments such as anthraquinone derivatives, anthoanthrone derivatives, dibenzopyrenequinone derivatives, pyranthrone derivatives and isoviolanthrone derivatives.

(4) Indigoid pigments such as indigo derivatives and thioindigo derivatives.

(5) Phthalocyanine pigments such as metallic phthalocyanines and non-metallic phthalocyanines.

As the CGM in the photoreceptor of the invention, it is particularly preferable to use organic pigments such as fluorenone-disazo pigments, fluorenylidene-disazo pigments, polycyclic quinone pigments, non-metallic phthalocyanine pigments or oxytitanyl-phthalocyanine pigments. Especially, the following fluorenone-disazo pigments, fluorenylidene-disazo pigments, polycyclic quinone pigments, X- and τ-type non-metallic phthalocyanine pigments and the oxytitanyl-phthalocyanine pigments disclosed in JP O.P.I. No. 17066/1989 are used in the invention, then the sensitivity, durability and image quality can be remarkably improved.

The fluorenone-disazo pigments used in the invention are represented by the following Formula I:

Formula I

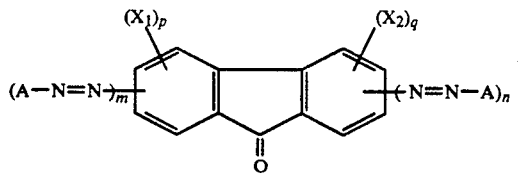

wherein $X_1$ and $X_2$ each represent a halogen atom, an alkyl group, an alkoxy group, a nitro group, a cyano group, a hydroxy group or a substituted or unsubstituted amino group: p and q each represent an integer of 0, 1 or 2, provided that when p and q each represent 2, $X_1$ and $X_2$ may be either the same or different from each other: and A represents a group represented by the following Formula I-1:

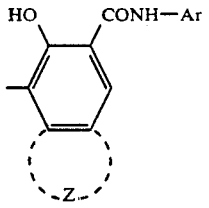

Formula I-1 wherein Ar represents a fluorinated hydrocarbon group or a substituted aromatic hydrocarbon group or an aromatic heterocylic group: Z represents a group of non-metallic atoms necessary to form a substituted or unsubstituted aromatic hydrocarbon ring or a substituted or unsubstituted aromatic heterocyclic ring: and m and n each represent an integer of 0, 1 or 2, provided that m and n are not simultaneously zero.

The following are examples of the fluorenone-disazo pigments used in the invention, but are not limited thereto.

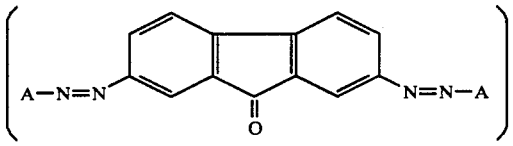

| No. | A |
|---|---|
| 1 | 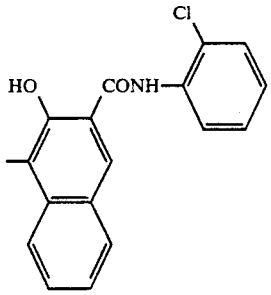  |
| 2 | 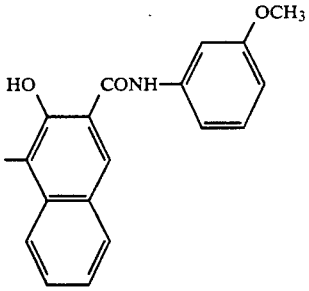  |
| 3 | 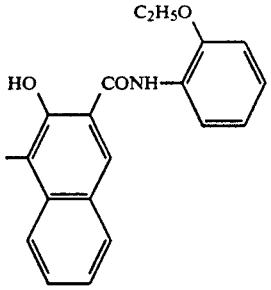  |
| 4 | 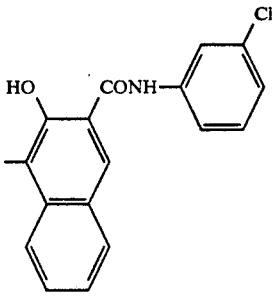  |

-continued

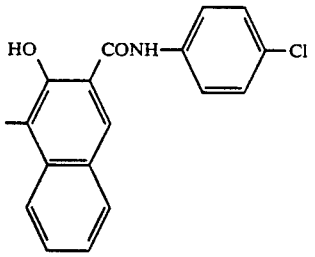

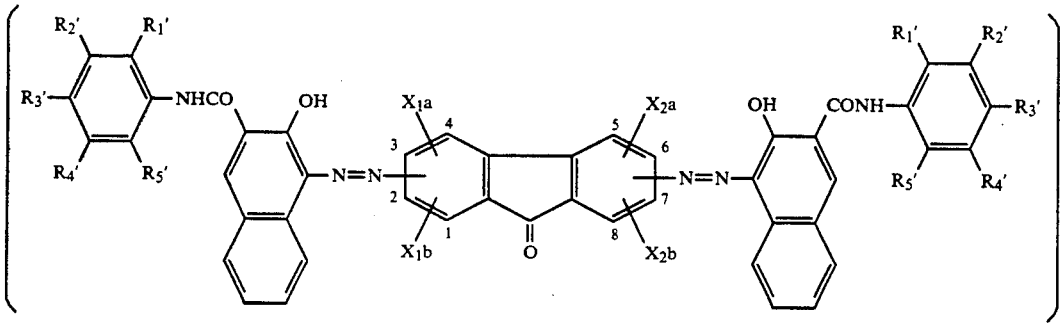

| No. | Azo group substituting position | $X_1a$ | $X_1b$ | $X_2a$ | $X_2b$ | $R_1'$ | $R_2'$ | $R_3'$ | $R_4'$ | $R_5'$ |
|---|---|---|---|---|---|---|---|---|---|---|
| 6 | 2,7 | 4-F | H | H | H | H | $CF_3$ | H | H | H |
| 7 | 2,7 | 4-F | H | H | H | $CF_3$ | H | H | $CF_3$ | H |
| 8 | 2,7 | 3-F | H | 5-F | H | $CF_3$ | H | H | H | H |
| 9 | 2,7 | 3-F | H | 6-OH | H | H | $CF_3$ | H | H | H |
| 10 | 2,7 | 4-Cl | H | H | H | H | $CF_3$ | Cl | H | H |
| 11 | 2,7 | 3-Cl | H | 6-Cl | H | H | $CF_3$ | H | H | H |
| 12 | 2,7 | 4-Br | H | H | H | H | $CF_3$ | H | H | H |
| 13 | 2,7 | 4-Br | H | 5-Br | H | H | H | $CF_3$ | H | H |
| 14 | 2,7 | 1-Br | 3-Br | 6-Br | H | H | $CF_3$ | H | H | H |
| 15 | 2,7 | 4-I | H | H | H | H | $CF_3$ | H | H | H |
| 16 | 2,7 | 4-I | H | H | H | $CF_3$ | H | H | $CF_3$ | H |
| 17 | 2,6 | 4-Cl | H | H | H | H | $CF_3$ | H | H | H |
| 18 | 3,6 | 2-Cl | H | 7-Cl | H | H | $CF_3$ | H | H | H |
| 19 | 3,6 | 4-Br | H | H | H | H | H | $CF_3$ | H | H |
| 20 | 3,6 | 4-I | H | H | H | Cl | H | H | $CF_3$ | H |
| 21 | 2,5 | 3-Br | H | H | H | H | $CF_3$ | H | H | H |
| 22 | 1,8 | 3-Cl | H | H | H | H | $CF_3$ | H | H | H |
| 23 | 2,7 | 4-Br | H | H | H | H | H | H | $CF_3$ | H |
| 24 | 2,7 | 4-I | H | H | H | H | $CF_3$ | H | H | Cl |

The fluorenone-disazo pigments represented by Formula I can be easily synthesized by known methods, e.g., the methods described in Japanese Patent Application No. 304862/1987.

The fluorenylidene-disazo pigments used in the invention are represented by the following Formula II:

Formula II

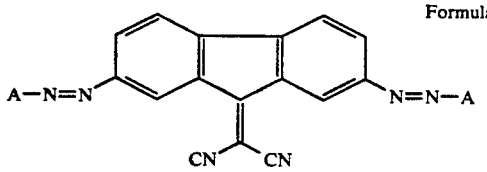

wherein A represents

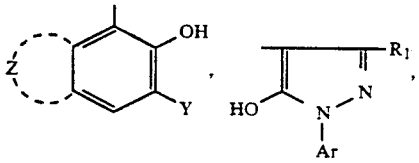

-continued

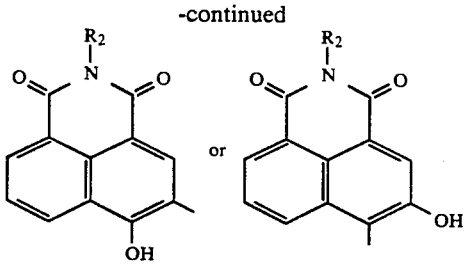

wherein Z represents an atomic group necessary to form a substituted or unsubstituted aromatic hydrocarbon ring, or a substituted or unsubstituted aromatic heterocyclic ring; Y represents a hydrogen atom, a hydroxy group, a carboxy group or a ester thereof, a sulfo group, a substituted or unsubstituted carbamoyl group, or a substituted or unsubstituted sulfamoyl group; $R_1$ represents a hydrogen atom, a substituted or unsubstituted alkyl group, a substituted or unsubstituted amino group, a substituted or unsubstituted carbamoyl group, a substituted or unsubstituted carboxy group or an ester group thereof, or a cyano group: Ar represents a substituted or unsubstituted aryl group: and $R_2$ represents a substituted or unsubstituted alkyl group, a substituted or unsubstituted aralkyl group or a substituted or unsubstituted aryl group.
Examples of the useful disazo pigments for the invention represented by Formula II include those having the following structural formulas:
II-1
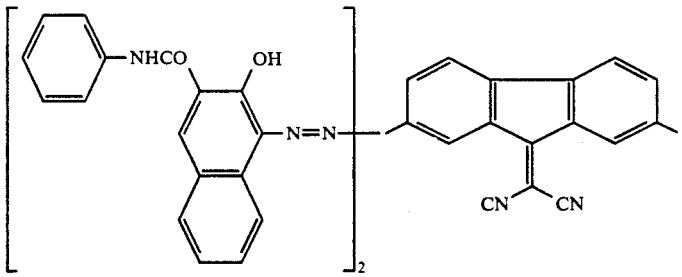
II-2
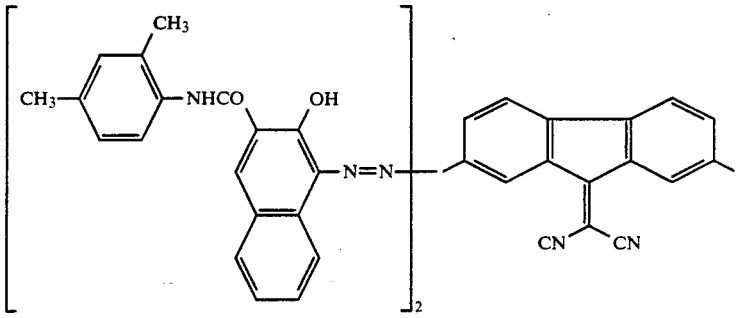
II-3
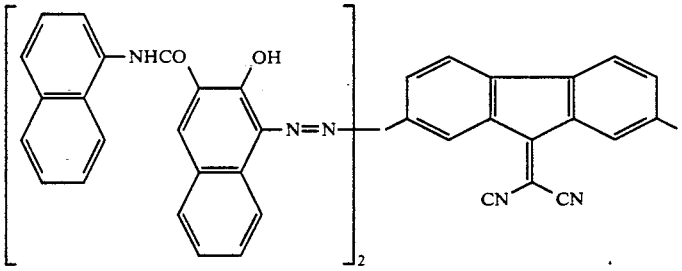
II-4
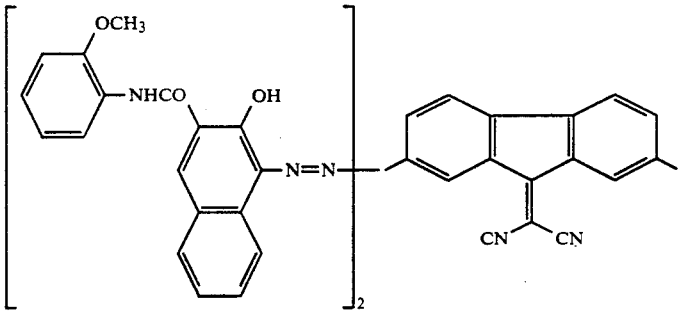
II-5
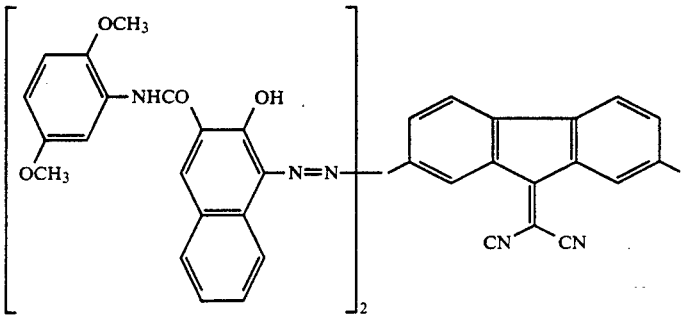

-continued
II-6
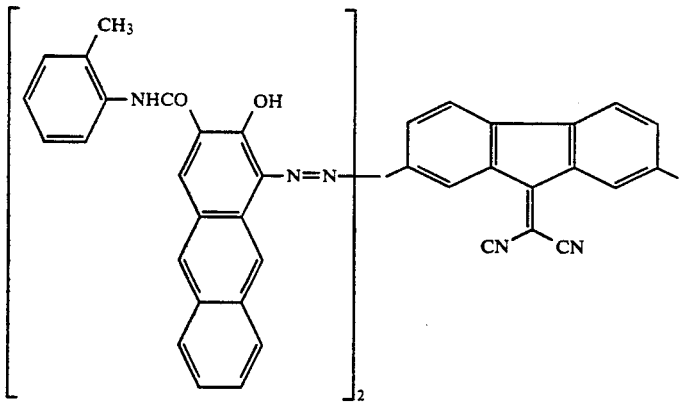
II-7
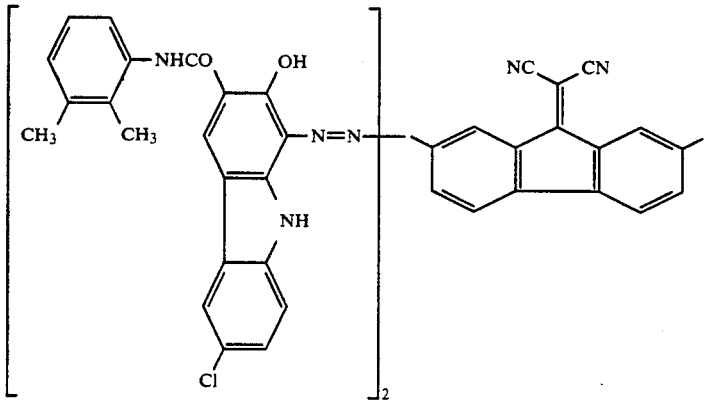
II-8
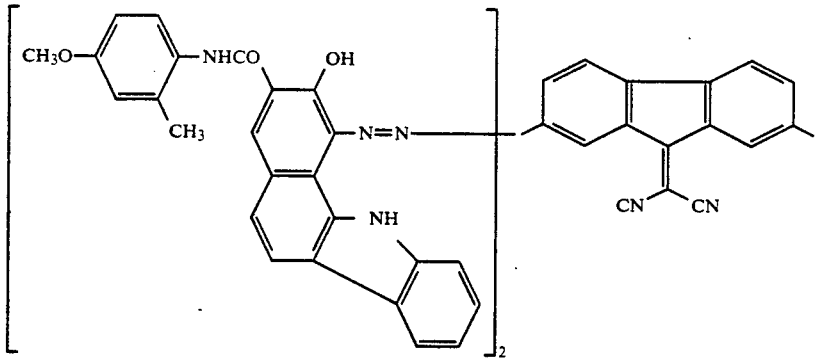
The polycyclic quinone pigments used in the invention are represented by the following Formulas A to C:
Formula A
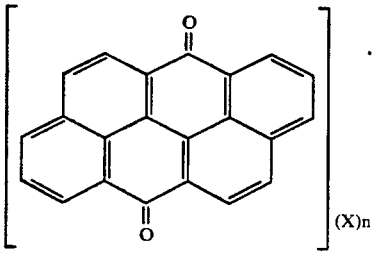
-continued
Formula B
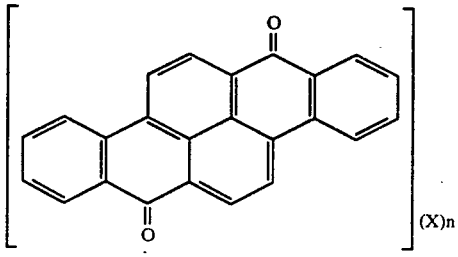

-continued

Formula C

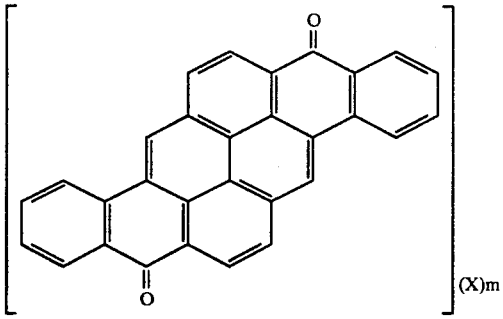

wherein X represents a halogen atom, a nitro group, a cyano group, an acyl group or a carboxy group; n is an integer of 0 to 4; and m is an integer of 0 to 6.

Examples of the polycyclic quinone pigments represented by the above Formulas A to C are given below:

Exemplified compounds as the anthoanthrone pigment represented by Formula A are as follows:

A1

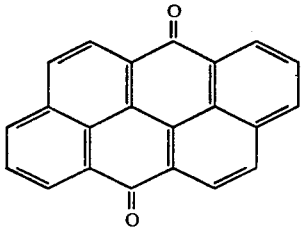

A2

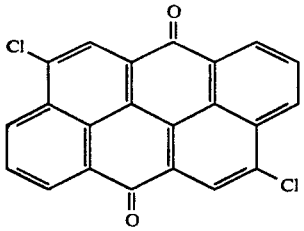

A3

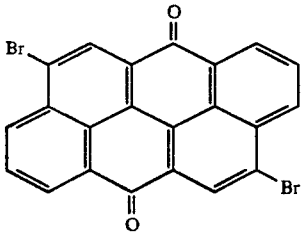

A4

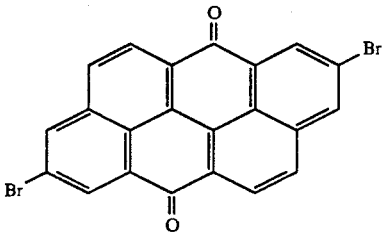

-continued

A5

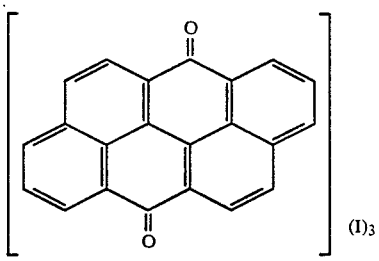

A6

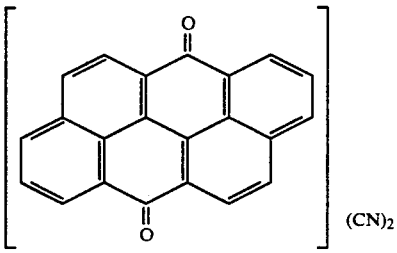

Exemplified compounds as the dibenzopyrenequinone pigment represented by Formula B are as follows:

B1

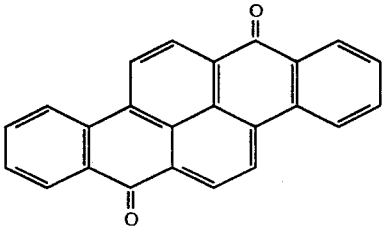

B2

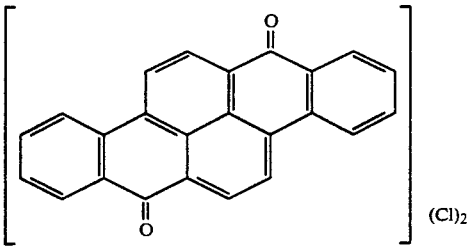

B3

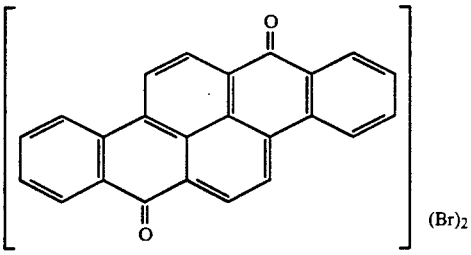

B4

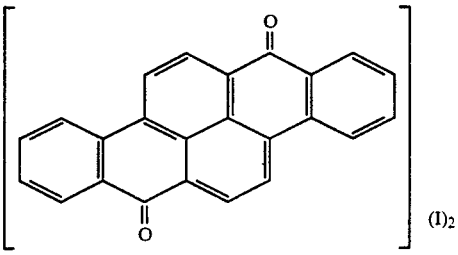

-continued

B5

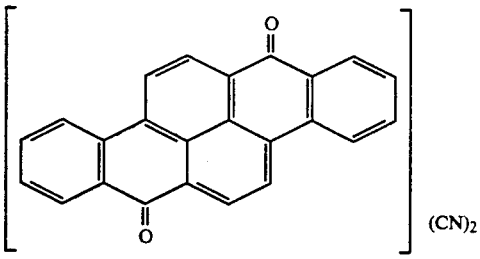

Exemplified compounds as the pyranthrone pigment represented by Formula C are as follows:

C1

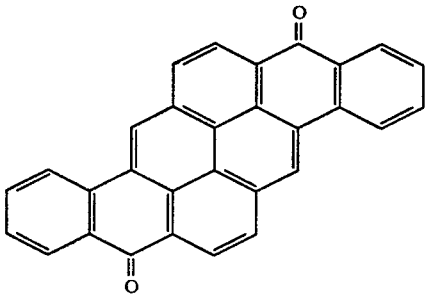

C2

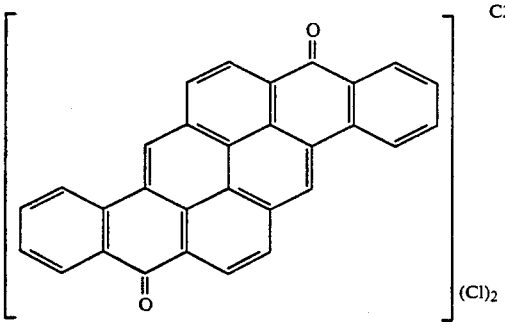

C3

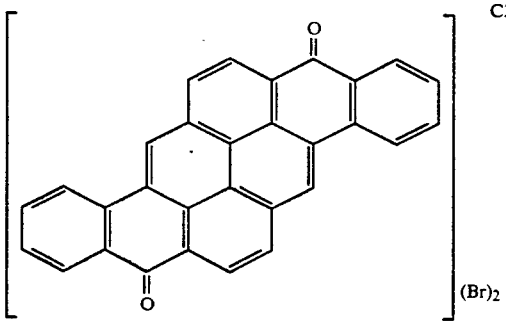

C4

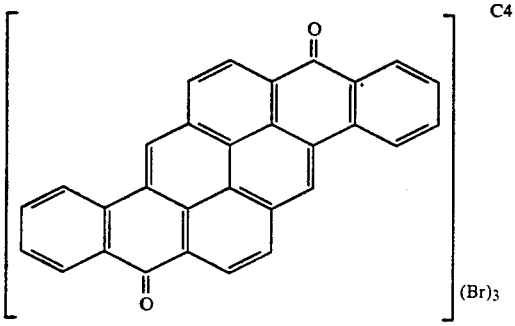

The polycyclic quinone pigments represented by Formulas A to C can be easily synthesized in accordance with known methods.

As the non-metallic phthalocyanine pigments of the invention, photoconductive non-metallic phthalocyanines and all the derivatives thereof can be used; for example, $\alpha$-type, $\beta$-type, $\tau$ or $\tau'$-type, $\eta$ or $\eta'$-type and X-tape non-metallic phthalocyanines, those in the crystalline form as described in JP O.P.I. 103651/1987, and the derivatives thereof can be used. Particularly preferred are those of the $\tau$, X, and K/R-X types. The X-type non-metallic phthalocyanines are described in U.S. Pat. No. 3,357,989. The $\tau$-type non-metallic phthalocyanines are disclosed in JP O.P.I. No. 182639/1987. The K/R-X type, as described in JP O.P.I. No. 103651/1987, is a phthalocyanine which, at Bragg's angles ($2\theta \pm 0.2°$) to the X-ray beam from a CuK$\alpha$ 1.541A radiation source, has principal peaks at 7.7, 9.2, 16.8, 17.5, 22.4 and 28.8 degrees, wherein the ratio of the peak strength at 16.8° to that at 9.2° is 0.8 to 1.0, and the ratio of the peak strength at 28.8° to that at 22.4° is not less than 0.4.

The oxytitanyl phthalocyanines usable in the invention are represented by the following Formula TP:

Formula TP

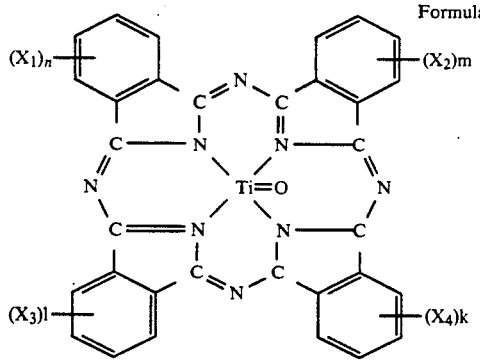

wherein $X_1$, $X_2$, $X_3$ and $X_4$ each represent a hydrogen atom, a chlorine atom or a bromine atom, and n, m, l and k each represent an integer of 0 to 4.

Particularly preferred among the oxytitanyl phthalocyanines used in the invention are oxytitanyl phthalocyanine TiOPc, titanyl chlorophthalocyanine TiOPcCl and the mixture thereof.

As the oxytitanyl phthalocyanine, there are those different in the crystal form which are disclosed in JP O.P.I. No. 239248/1986, 670943/1987, 272272/1987, 116158/1988 and 17066/1989.

The photoreceptor of the invention has, e.g., a construction as shown in FIG. 1.

Figure 2:
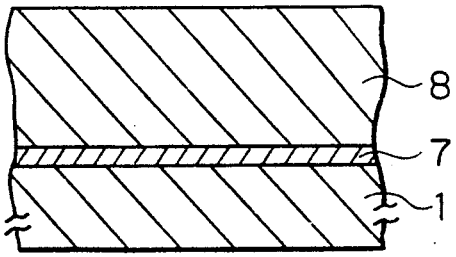
Figure 3:
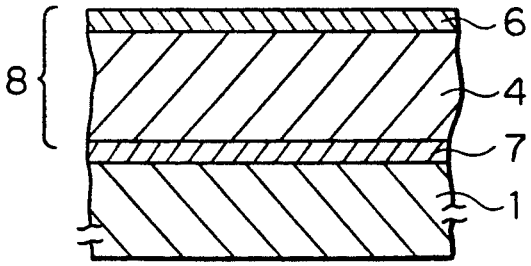
Figure 4:
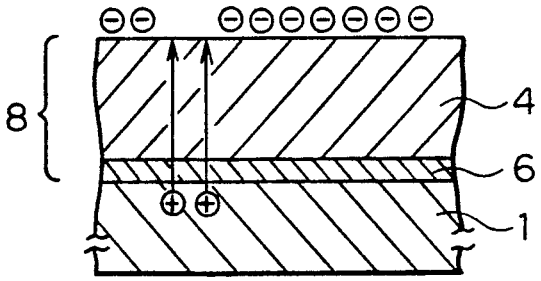

In this photoreceptor, on a conductive support 1, through an undercoat layer 7, is provided CGL 6, on which is further provided CTL 4. 8 is a photosensitive layer. The undercoat layer 7 provided between CGL 6 and the support 1 functions to effectively prevent the not uniform hole's movement from the support side as shown in FIG. 4, while the layer at the time of radiation can transport efficiently electrons as light carrier to the support side. The photoreceptor of the invention, aside from the above construction (CTL provided on CGL), may comprise a single photosensitive layer 8 containing a mixture of CGM and CTM as shown in FIG. 2. Alternatively, the photoreceptor may be of a construction wherein CGL 6 and CTL 4 are made upside down (for positively charging) as shown in FIG. 3.

In the photoreceptor of the invention, in order to improve the plate wear, on the surface thereof may be provided a protective layer, for example, by coating a synthetic resin layer.

In the invention, CGL may be formed in the manner that one of the foregoing organic pigments alone or in combination with an appropriate binder resin is dispersed in an appropriate dispersing medium or solvent, and the dispersion is coated on the undercoat layer or CTL by a dip coating, spray coating. blade coating or roll coating method, and then dried, The organic pigment of the invention may be pulverized into fine particles having appropriate particle sizes by using a ball mill, homomixer, sand mill, ultrasonic disperser, attritor or sand grinder, and then dispersed in a dispersing medium.

Examples of the dispersing medium for the organic pigments usable in the invention include hydrocarbons such as hexane, benzene, toluene and xylene; halogenated hydrocarbons such as methylene chloride, methylene bromide, 1,2-dichloroethane, syntetrachloroethane, cis-1,2-dichloroethylene, 1,1,2-trichloroethane, 1,1,1-trichloroethane, 1,2-dichloropropane, chloroform, bromoform and chlorobenzene: ketones such as acetone, methylethyl ketone and cyclohexanone: esters such as ethyl acetate and butyl acetate: alcohols such as methanol, ethanol, propanol, butanol, cyclohexanol, heptanol, ethylene glycol, methyl cellosolve, ethyl cellosolve and cellosolve acetate, and the derivatives thereof: ethers and acetals such as tetrahydrofuran, 1,4-dioxane, furan and furfural: amines such as pyridine, butylamine, diethylamine, ethylenediamine and isopropanol; nitrogen compounds including amides such as N,N-dimethylformamide; fatty acids and phenols: and sulfur and phosphorus such as carbon disulfide and triethyl phosphate.

In the invention, CGL may contain one or more electron acceptors for the purpose of improving the sensitivity and residual potential and reducing the fatigue of the photoreceptor when repeatedly used.

Examples of the above electron acceptor include succinic anhydride, maleic anhydride, dibromomaleic anhydride, phthalic anhydride, tetrachlorophthalic anhydride, tetrabromophthalic anhydride, 3-nitrophthalic anhydride, 4-nitrophthalic anhydride, pyromellitic anhydride, tetracyanoethylene, tetracyanoquinodimethane, o-dinitrobenzene, m-dinitrobenzene, 1,3,5-trinitrobenzene, p-nitrobenzonitrile, picryl chloride, quinonechloroimide, chloranil, bromanil, dichlorodicyano-p-benzoquinone, anthraquinone, dinitroanthraquinone, 2,7-dinitrofluorenone, 2,4,7-trinitrofluorenone, 2,4,5,7-tetranitrofluorenone, 9-fluorenylidene[dicyanomethylenemalonodinitrile], polynitro -9-fluorenylidene-[dicyanomethylenemalonodinitrile), picric acid, o-nitrobenzoic acid, p-nitrobenzoic acid, 3,5-dinitrobenzoic acid, pentafluorobenzoic acid, 5-nitrosalicylic acid, phthalic acid, mellitic acid, and other compounds having large electron affinities. The adding ratio by weight of the organic pigment : electron acceptor is 100:0.01-200, and preferably 100:0.1-100.

The electron acceptor may be added to CTL. The adding ratio by weight of CTM : electron acceptor is 100:0.01-100, and preferably 100:0.1-50.

Where the photoreceptor of the invention is of a multi-layer construction, the ratio by weight of the binder : CGM : CTM in the CGL is 0-100:1-500:0-500. Where the foregoing copolymer nylon is used in CGL, the ratio by weight of the binder : the copolymer nylon is 0-100:1, while used in CTL, the binder : the copolymer nylon is 0-100:1, and in the whole binder, the binder : the copolymer nylon is 0-100.

The thickness of the CGL thus formed is preferably 0.01 to 10μm, and more preferably 0.1 to 5 μm.

The formation of CTL may be made by coating and drying a dispersion of CTM alone or in combination with the above binder resin dissolved and dispersed in a solvent or dispersing medium. The dispersing medium to be used may be the same as the one for use in dispersing the above CGM.

Examples of the CTM usable in the invention include oxazole derivatives, oxadiazole derivatives, thiazole derivatives. thiadiazole derivatives, triazole derivatives, imidazole derivatives, imidazolone derivatives, imidazolidine derivatives, bisimidazolidine derivatives, styryl compounds, hydrazone compounds, pyrazoline derivatives, amine derivatives, oxazolone derivatives, benzothiazole derivatives, benzimidazole derivatives, quinazoline derivatives, benzofuran derivatives, acrydine derivatives, phenazine derivatives, aminostilbene derivatives, poly-N-vinylcarbazole, poly-1-vinylpyrene, poly-9-vinylanthracene, and the like.

The CTM used in the invention is preferably one having an excellent ability of transporting to the support side the hole generated at the time of light irradiation and being suitably usable in combination with any one of the foregoing organic pigments of the invention. Compounds usable as the CTM are those represented by the following Formulas T-A, T-B and T-C:

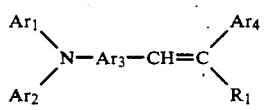

Formula T-A wherein $Ar_1$, $Ar_2$ and $Ar_4$ each represent a substituted or unsubstituted aryl group: $Ar_3$ represents a substituted or unsubstituted arylene group: and $R_1$ represents a hydrogen atom, a substituted or unsubstituted alkyl group or a substituted or unsubstituted aryl group. Examples of the compound are detailed in JP O.P.I. Nos. 65440/1983 and 198043/1983.

Formula T-B

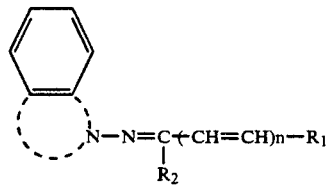

wherein $R_1$ represents a substituted or unsubstituted aryl group or a substituted or unsubstituted heterocyclic group: $R_2$ is a hydrogen atom or a substituted or unsubstituted alkyl group or a substituted or unsubstituted aryl group: and n represents an integer of 0 or 1. Details thereof are described in JP O.P.I. Nos. 134642/1983 and 166354/1983.

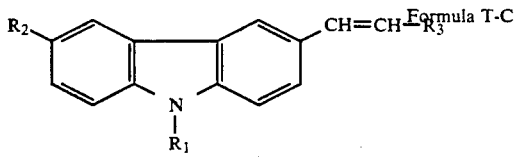

Formula T-C wherein $R_1$ represents a substituted or unsubstituted aryl group: $R_2$ represents a hydrogen atom, a halogen atom or a substituted or unsubstituted alkyl group, a substituted or unsubstituted alkoxy group, a substituted or unsubstituted amino group or a hydroxy group: and $R_3$ represents a substituted or unsubstituted aryl group or a substituted or unsubstituted heterocyclic group.

Synthesis methods and examples thereof for producing these compounds are detailed in Japanese Patent Examined Publication No. 148750/1982.

Other compounds suitable as the CTM of the invention are the hydrazone compounds described in JP O.P.I. Nos. 67940/1982, 15252/1984 and 101844/1982.

The CTM content of the CTL is preferably 20 to 200 parts by weight, more preferably 30 to 150 parts by weight per 100 parts by weight of the binder resin of CTL.

The thickness of CTL is preferably 5 to 50 μm, and more preferably 5 to 30 μm.

Where the photoreceptor of the invention is of a single layer function separation type which uses the organic pigment, the ratio by weight of the binder : organic pigment : CTM is preferably 0–100:1–500:0–500, and the thickness of the photosensitive layer formed is preferably 5 to 50 μm, more preferably 5 to 30 μm.

As the binder resin for the photosensitive layer, protective layer and undercoat layer, in addition to the N-modified nylon resin of the invention, there may be used other resins including addition polymerization-type resins and polyaddition-type resins such as polystyrene, polyethylene, polypropylene, acryl resin, methacryl resin, vinyl chloride resin, vinyl acetate resin, polyvinylbutyral resin, epoxy resin, polyurethane resin, phenol resin, polyester resin, alkyd resin, polycarbonate resin, silicone resin, melamine resin, and copolymer resins containing two or more of repetitive units of these resins such as vinyl chloride-vinyl acetate copolymer resin, vinyl chloride-vinyl acetate-malic anhydride copolymer resins, and further high molecular organic semiconductors such as poly-N-vinyl-carbazole.

To the photosensitive layer of the invention, for the purpose of improving the charge generating function of CGM, may be added preferably an organic amine, particularly a secondary amine. Useful examples of the amine are described in JP O.P.I. Nos. 218447/1984 and 8160/1987.

To the photosensitive layer of the invention may be added an antioxidation agent in order to be prevented from being deteriorated by ozone.

Typical examples of the above antioxidation agent are as follows, but are not limited thereto:

Group I: Hindered phenols,

Group II: p-Phenylenediamines,

Group III: Hydroquinones,

Group IV: Organic sulfur compounds,

Group V: Organic phosphorus compounds.

These compounds are disclosed in JP O.P.I. No. 18354/1988.

These compounds are known as the oxidation agents for rubber, plastics, oils and fats, and commercially available.

The antioxidation agent may be added to CGL, CTL or the protective layer, preferably to CTL. The adding amount of the antioxidation agent is 0.1 to 100 parts by weight, preferably 1 to 50 parts by weight, and more preferably 5 to 25 parts by weight per 100 parts by weight of CTM.

The photosensitive layer of the invention may, if necessary, contain an ultraviolet absorbing agent to protect the layer, and also a dye for color sensitivity correction.

The conductive support for the photosensitive layer may be a metallic plate such as aluminum or nickel, a metallic drum or foil, a plastic film on which is vacuum evaporated aluminum, tin oxide, indium oxide, etc., or a conductive substance-coated paper or plastic film or drum.

The photoreceptor containing the organic pigment of the invention is well sensitive to visible rays and near infrared rays, and preferably has its absorption maximum in the wavelengths between 400 and 850 nm.

Light sources emitting lights having the absorption maximum in the wavelengths include halogen lamps, fluorescent lamps, tungsten lamps: gas lasers such as argon laser, helium or neon layer; and semiconductor lasers.

The electrophotographic photoreceptor of the invention is of the above construction and, as apparent from the examples hereinafter described, has excellent charging rise characteristics, charging characteristics, sensitivity and image forming characteristics, and is less fatigued to be deteriorated even when repeatedly used, thus having an excellent durability. Further, the photoreceptor, when subjected to a reversal development, produces an image with almost no black spots.

EXAMPLES

The present invention is illustrated in detail by the following examples.

EXAMPLE 1

An aluminum cylinder having a diameter of 80 mm was dipped in and then lifted at a speed of 60 cm/min from a solution that was prepared by dissolving in 1000 ml of a methanol/butanol (=4/I by volume) mixed solvent 30 g of Dai-amide X-1874M, produced by Dai-Cell-Heuls Co., which is a methoxylated (substituted rate: 20 mole%) product of a nylon copolymer comprised principally of nylon 12, trade name by DuPont, comprising a unit represented by the following Formula 1, as a barrier substance (hereinafter abbreviated to CBM), and then dried at room temperature, whereby an undercoat layer having a thickness of 1.0 μm was provided on the cylinder.

Next, 20 g of a fluorenone bisazo pigment (exemplified compound 12) as CGM and 10 g of polyvinyl butyral resin Eslex BX-1 as a binder were dissolved in 1000 ml of methylethyl ketone (MEK) and dispersed for 10 hours by a sand mill, whereby a CGL coating solution was obtained. The aforementioned cylinder was dipped in this coating solution and lifted at a speed of 60 cm/min therefrom, and then dried at room temperature to thereby provide a 0.5 μm-thick CGL on the cylinder.

After that, a compound as CTM having the following Formula T and 165 g of polycarbonate resin Iupilon Z-200, produced by Mitsubishi Gas Chemical Industry Co., were dissolved in 1000 ml of 1,2 dichloroethane (EDC) to prepare a CTL coating solution. The foregoing cylinder wa dipped in this coating solution and lifted at a speed of 24 cm/min therefrom, and then dried for one hour at 100° C., whereby CTL having a dry thickness of 20 μm was provided on the cylinder. Thus, a photoreceptor comprising the cylinder having thereon the undercoat layer, CGL and CTL formed in the described order was prepared.

$-NH-(CH_2)_{11}-CO-$ Formula 1

Formula T

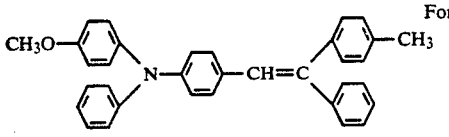

EXAMPLE 2

An undercoat layer-CGL-CTL-provided photoreceptor was prepared in the same manner as in Example 1 except that polyvinylbutyral resin Eslec BM-S, produced by Sekisui Chemical Ind. Co., was used as the binder for CGL.

EXAMPLE 3

An undercoat layer-CGL-CTL-provided photoreceptor was prepared in the same manner as in Example 1 except that a fluorenone bisazo pigment (exemplified compound 15) was used as CGM.

EXAMPLE 4

An undercoat layer-CGL-CTL-provided photoreceptor was prepared in the same manner as in Example 3 except that polyvinylbutyral resin Eslec BMS, produced by Sekisui Chemical Ind. Co., was used as the binder for CGL.

EXAMPLE 5

An undercoat layer-CGL-CTL-provided photoreceptor was prepared in the same manner as in Example I except that a fluorenylidene bisazo pigment (exemplified compound II-8) was used as CGM.

EXAMPLE 6

An undercoat layer-CGL-CTL-provided photoreceptor was prepared in the same manner as in Example 5 except that polyvinylbutyral resin Eslec BMS, produced by Sekisui Chemical Ind. Co., was used as the binder for CGL.

EXAMPLE 7

An undercoat layer-CGL-CTL-provided photoreceptor was prepared in the same manner as in Example 1 except that a 1.0 μm-thick undercoat layer was formed on a support in the manner that the support was dipped in and lifted at a speed of 60 cm/-min from a solution that was prepared by dissolving 24 g of a methoxylated nylon copolymer comprised principally of nylon 12, comprising a unit represented by the Formula 1, Dai-amide X-1874M, produced by Daicel-Huls Co., and 6 g of nylon-6/66/6.10/12 copolymer CM8000, produced by Toray Corp., in a methanol/butanol mixed solvent (mixing ratio by volume: 4/1).

EXAMPLE 8

An undercoat layer-CGL-CTL-provided photoreceptor was prepared in the same manner as in Example 1 except that the methoxylated nylon of Example 1 was replaced by ethylated nylone.

EXAMPLES 9 to 11

Photoreceptors were prepared in the same manner as in Example 1 except that the fluorenone-bisazo pigment (exemplified Compound 12) as CGM in Example 1 was replaced by a polycyclic quinone pigment (exemplified Compound B3), K/R-X type non-metallic phthalocyanine and the following oxytitanyl-phthalocyanine TP-1 represented by the foregoing Formula TP.

TP-1

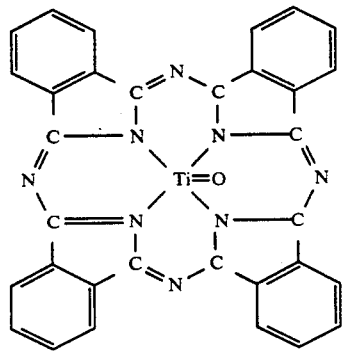

COMPARATIVE EXAMPLE 1

An undercoat layer-CGL-CTL-provided photoreceptor was prepared in the same manner as in Example 1 except that the methoxylated product of the nylon copolymer comprised principally of nylon-12 used in Example 1 was replaced by Toresin F-30, produced by Teikoku Chemical Ind. Co., which is a N-methoxylated nylone comprised principally of nylon-6.

COMPARATIVE EXAMPLE 2

An undercoat layer-CGL-CTL-provided photoreceptor was prepared in the same manner as in Example 1 except that the methoxylated product of the nylon copolymer comprised principally of nylon-IZ used in Example 1 was replaced by a nylon-6/66/610/12 copolymer CM8000, produced by Toray Corp.

COMPARATIVE EXAMPLE 3

An undercoat layer-CGL-CTL-provided photoreceptor was prepared in the same manner as in Example 1 except that the methoxylated product of the nylon copolymer comprised principally of nylon-12 used in Example 1 was replaced by a nylon-6/66/610 copolymer Ultramid-14, produced by BASF Co.

COMPARATIVE EXAMPLE 4

An undercoat layer-CGL-CTL-provided photoreceptor was prepared in the same manner as in Example 1 except that in place of the methoxylated product of the nylon copolymer comprised principally of nylon-12 used in Example 1, 120 g of a 25% aqueous solution of polyvinyl acetal resin Eslec W-201, produced by Sekisui Chemical Ind. Co., were dissolved in 880 ml of a water/methanol (ratio by weight of 4/1) mixed solvent to prepare a solution, and a support was dipped in the solution and lifted at a speed of 60 cm/min therefrom and then dried at room temperature to thereby form a 1.0 μm-thick undercoat layer on the support.

COMPARATIVE EXAMPLE 5

A photoreceptor was prepared in the same manner as in Example 1 except that the undercoat layer was excluded from Example 1.

The constructions of the above photoreceptors samples are listed in Table 1.

Each photoreceptor sample was loaded in a remodelled type of KONICA U-Bix 1017, manufactured by KONICA Corporation, and a potential measuring probe Model 644, produced by Trek Co., was provided in the position of the developing device to measure various characteristics of the sample. The results are shown in Table 2.

TABLE 1

| Sample No. | Photoreceptor construction UCM*1/solvent | CGM/binder/solvent | CTM/binder/solvent |
|---|---|---|---|
| Example-1 | X-1874M | Ex*12/BX-1/MEK | T/Z-200/EDC |
| Example-2 | " | Ex 12/BMS/MEK | " |
| Example-3 | " | Ex 15/BX-1/MEK | " |
| Example-4 | " | Ex 15/BMS/MEK | " |
| Example-5 | " | Ex II-8/BX-1/MEK | " |
| Example-6 | " | Ex II-8/BMS/MEK | " |
| Example-7 | X-1874M/CM8000 | Ex 12/BX-1/MEK | " |
| Example-8 | N-ethylated nylon | Ex 12/BX-1/MEK | " |
| Example-9 | X-1874M | B-3/BX-1/MEK | " |
| Example-10 | " | K/R-X/BX-1/MEK | " |
| Example-11 | " | TP-1/BX-1/MEK | " |
| Comparison-1 | Tresin F30 | Ex 12/BX-1/MEK | T/Z-200/EDC |
| Comparison-2 | CM8000 | " | " |
| Comparison-3 | Ultramid 1C | " | " |
| Comparison-4 | W-201 | " | " |
| Comparison-5 | No UCL*2 | " | " |

Note:
*Ex: Exemplified compound
*1UCM: Undercoat material
*2UCL: Undercoat layer

TABLE 2

| Sample No. | Charging rise characteristics $-V_{10}$ (V) | $-V_{20}$ (V) | $-V_{30}$ (V) | Electrophotographic characteristics: Low temp/humid 10° C./20% Initial -Vb (V) | Initial -Vr (V) | After 50,000C -Vb (V) | After 50,000C -Vr (V) | Normal temp/humid 20° C./40% Initial -Vb (V) | Initial -Vr (V) | After 50,000C -Vb (V) | After 50,000C -Vr (V) | High temp/humid 33° C./80% Initial -Vb (V) | Initial -Vr (V) | After 50,000C -Vb (V) | After 50,000C -Vr (V) | Image quality | Adhesion property |
|---|---|---|---|---|---|---|---|---|---|---|---|---|---|---|---|---|---|
| Example-1 | 270 | 480 | 670 | 740 | 8 | 740 | 30 | 740 | 5 | 740 | 20 | 730 | 5 | 740 | 20 | A | 100/100 |
| Example-2 | 250 | 470 | 665 | 710 | 5 | 720 | 25 | 700 | 8 | 720 | 25 | 704 | 10 | 720 | 25 | A | 95/100 |
| Example-3 | 235 | 400 | 580 | 730 | 5 | 710 | 32 | 720 | 7 | 730 | 25 | 740 | 7 | 760 | 28 | A | 100/100 |
| Example-4 | 220 | 405 | 615 | 680 | 7 | 698 | 30 | 710 | 10 | 720 | 22 | 697 | 10 | 706 | 30 | A | 97/100 |
| Example-5 | 210 | 400 | 605 | 670 | 5 | 700 | 38 | 700 | 10 | 720 | 20 | 670 | 15 | 685 | 38 | B | 100/100 |
| Example-6 | 200 | 385 | 600 | 660 | 10 | 690 | 40 | 700 | 5 | 715 | 20 | 680 | 15 | 690 | 40 | B | 90/100 |
| Example-7 | 130 | 320 | 570 | 700 | 10 | 715 | 30 | 715 | 5 | 730 | 20 | 680 | 10 | 710 | 35 | B | 83/100 |
| Example-8 | 220 | 410 | 590 | 730 | 7 | 745 | 35 | 705 | 10 | 720 | 20 | 700 | 10 | 705 | 30 | A | 98/100 |
| Example-9 | 270 | 500 | 700 | 630 | 12 | 650 | 30 | 600 | 5 | 620 | 25 | 630 | 5 | 650 | 30 | B | 90/100 |
| Example-10 | 200 | 395 | 590 | 700 | 5 | 720 | 35 | 670 | 5 | 685 | 15 | 705 | 5 | 720 | 32 | B | 85/100 |
| Example-11 | 250 | 500 | 688 | 680 | 10 | 695 | 35 | 650 | 5 | 665 | 20 | 685 | 5 | 710 | 30 | B | 95/100 |
| Comparison-1 | 78 | 150 | 225 | 660 | 15 | 700 | 70 | 650 | 10 | 670 | 30 | 640 | 10 | 660 | 90 | C | 50/100 |
| Comparison-2 | 10 | 110 | 280 | 650 | 15 | 705 | 85 | 640 | 5 | 650 | 40 | 625 | 10 | 670 | 100 | C | 62/100 |
| Comparison-3 | 15 | 160 | 350 | 600 | 30 | 645 | 100 | 600 | 10 | 590 | 35 | 585 | 15 | 620 | 100 | D | 40/100 |
| Comparison-4 | 10 | 130 | 310 | 620 | 20 | 680 | 120 | 590 | 10 | 610 | 30 | 600 | 10 | 630 | 105 | D | 48/100 |
| Comparison-5 | 5 | 120 | 300 | 590 | 30 | 625 | 120 | 595 | 5 | 580 | 36 | 565 | 20 | 5 | 100 | D | 0/100 |

Measurement of charging rise characteristics

Each photoreceptor, while being rotated at a constant rate, was charged and then discharged by light, and its charged potential was designated as $V_{10}$ (V) at a flow-in current of 10μA to the photoreceptor, as $V_{20}$ (V) at 20 μA, and as $V_{30}$ (V) at 30 μA.

Measurement of repetitive characteristics

Each photoreceptor was loaded in the foregoing copier for 50,000 copies making test run, and the surface potentials before and after the copies-making operation were measured. Further, the dependence characteristics of the photoreceptor upon the following three environmental conditions: normal, low and high temperatures/-humidities, were examined.

In the table, the black paper potential Vb represents a surface potential to an original having a reflection density of 1.3, while the Vr is a residual potential.

Image quality

The quality of the image of the 50,000th copy was evaluated according to the following evaluation grades:

Grade A Reflection density: 1.3 or more: no fog.
Grade B High reflection density.
Grade C Fogged.
Grade D Uneven density.

Adhesion property

The adhesion property of the undercoat layer to the support was evaluated in accordance with the grid test (JIS K5400). Namely, a cutter guide having eleven blades side by side at 1 mm intervals was used to make vertical and lateral parallel cut lines on the photoreceptor so that the cut reaches the conductive support thereof to thereby form a grid cut pattern having 100 squares. Onto the grid pattern is applied a 24 mm wide cellophane tape, and then the tape, by lifting its end up, is peeled apart therefrom. Then, the number of the squares peeled off is counted, and the adhesion property is expressed by the number of the remaining squares out of 100. The evaluation criteria is: 100/100 excellent, and 0/100 bad. AB is apparent from Table 2, the photoreceptors of the invention have higher charged potentials than those of the comparative ones at the same flow-in current values, and also have excellent charging rise characteristics. The photoreceptors of the invention are less dependent upon environmental conditions, showing less rise in the residual potential even under low or high temperature/humidity conditions than the comparative samples. Further, each of the photoreceptors of the invention can form a fogless image having a sufficient density even when used for a run of making 50,000 copies, whereas each comparative photoreceptor produces a foggy image having no sufficient density.

What is claimed is:

1. An electrophotographic photoreceptor comprising a conductive support and, provide thereon, an undercoat layer, a carrier generating layer and a carrier transport layer in this order, wherein said undercoat layer contains an N-alkoxylated polyamide copolymer or N-alkylated polyamide copolymer comprising a unit represented by the following Formula 1 in an amount of 20 to 80 mol %:

$$-NH-(CH_2)_{11}-CO-. \qquad \text{Formula 1}$$

2. The photoreceptor of claim 1, wherein said carrier generating layer comprises one selected from the group consisting of the compounds represented by the following Formulae I, II, A, B and C:

Formula I

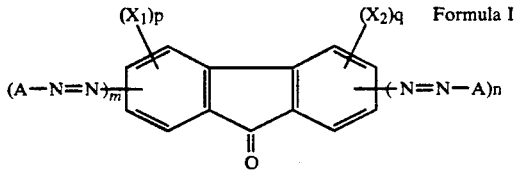

wherein $X_1$ and $X_2$ each represent a halogen atom, an alkyl group, an alkoxy group, a nitro group, a cyano group, a hydroxy group or an amino group; p and q each represent an integer of 0, 1 or 2, provided that $X_1$ and $X_2$ may be the same as or different from each other when p and q are 2; and A represents a group represented by the following Formula I-1;

Formula I-1

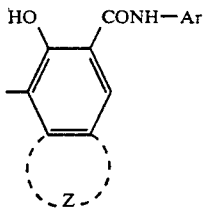

wherein Ar represents a fluorinated hydrocarbon group, a substituted aromatic hydrocarbon group or aromatic heterocyclic group; Z represents a non-metallic group necessary to form an aromatic hydrocarbon ring or aromatic heterocyclic ring; m and n each represent an integer of 0, 1 or 2, provided that m and n are not simultaneously 0;

Formula II

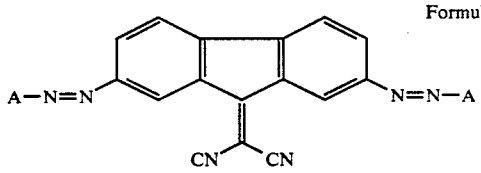

wherein A represents the following formulas;

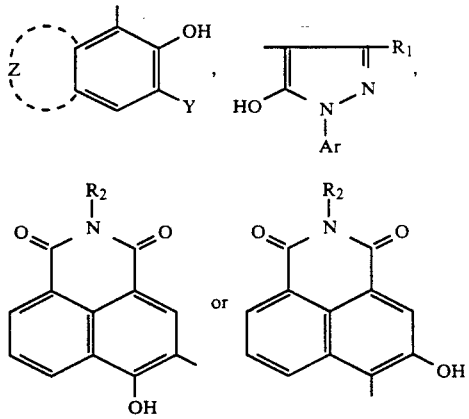

wherein Z represents an atomic group necessary to form an aromatic hydrocarbon ring or an aromatic heterocyclic ring; Y represents a hydrogen atom, a hydroxy group, a carboxy group or an ester group thereof, a sulfo group, a carbamoyl group or a sulfamoyl group; $R_1$ represents a hydrogen atom, an alkyl group, an amino group, a carbamoyl group, a carboxy group or an ester group thereof, or a cyano group; Ar represents an aryl group; and $R_2$ represents an alkyl group, an aralkyl group or an aryl group;

Formula A

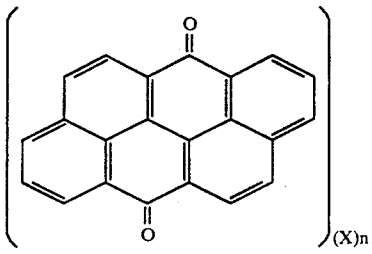

-continued

Formula B

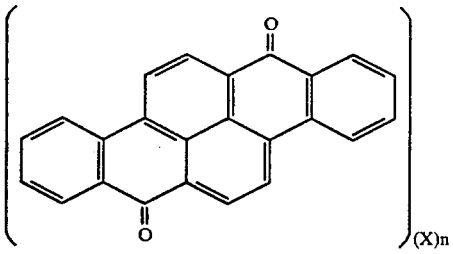

Formula C

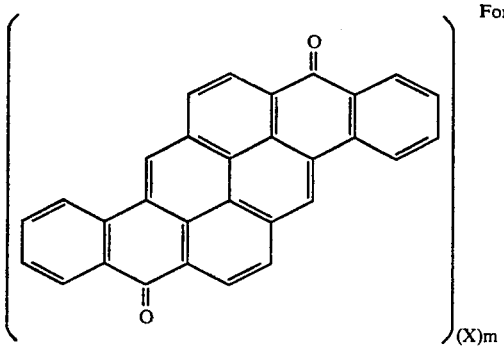

Wherein X represents a halogen atom, a nitro group, a cyano group, an acyl group or a carboxy group; n represents an integer of 0 to 4; and m represents an integer of 0 to 6.

3. The photoreceptor of claim 2, wherein said carrier transport layer comprises a compound selected from the group consisting of the compounds represented by the following Formulae T-A, T-B and T-C;

T-A

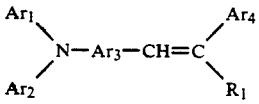

wherein $Ar_1$, $Ar_2$, and $Ar_4$ each represent an aryl group, $Ar_3$ represents an arylene group, and $R_1$ represents a hydrogen atom, an alkyl group or an aryl group,

T-B

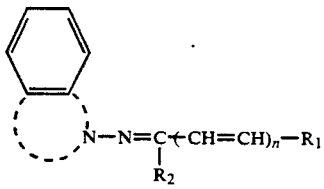

wherein $R_1$ represents an aryl group or a heterocyclic group, $R_2$ represents a hydrogen atom, an alkyl group or an aryl group, and n represents an integer of 0 or 1.

T-C

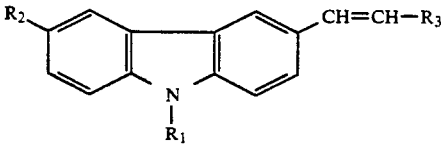

wherein $R_1$ represents an aryl group, $R_2$ represents a hydrogen atom, a halogen atom, an alkyl group, an alkoxy group, an amino group or a hydroxy group, and $R_3$ represents an aryl group or a heterocyclic group.

4. The photoreceptor of claim 1, wherein said carrier generating layer comprises a non-metallic phthalocyanine or an oxytitanyl phthalocyanine represented by the following Formula TP:

Formula TP

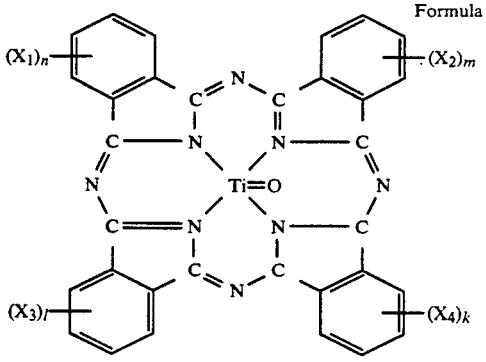

wherein $X_1$, $X_2$, $X_3$ and $X_4$ each represent a hydrogen atom, a chlorine atom or a bromine atom; and n, m, l and k independently represent an integer of 0 to 4.

5. The photoreceptor of claim 3, wherein said carrier transport layer comprises a compound selected from the group consisting of the compounds represented by the following Formulas T-A, T-B and T-C;

T-A

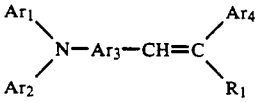

wherein $Ar_1$, $Ar_2$, and $Ar_4$ each represent an aryl group, $Ar_3$ represents an arylene group, and $R_1$ represents a hydrogen atom, an alkyl group or an aryl group,

T-B

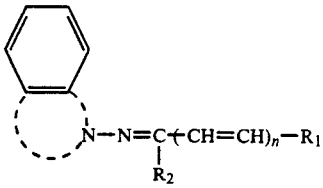

wherein $R_1$ represents an aryl group or a heterocyclic group, $R_2$ represents a hydrogen atom, an alkyl group or an aryl group, and n represents an integer of 0 or 1.

T-C

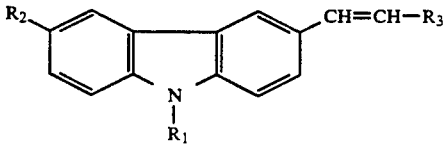

wherein $R_1$ represents an aryl group, $R_2$ represents a hydrogen atom, a halogen atom, an alkyl group, an alkoxy group, an amino group or a hydroxy group, and $R_3$ represents an aryl group or a heterocyclic group.

6. The photoreceptor of claim 1, wherein said N-alkoxylated polyamide copolymer comprises an alkoxy group in an amount of 18 to 50% based on the total amount of an amide bond.

7. The photoreceptor of claim 1, wherein said N-alkoxylated polyamide copolymer comprises an alkoxy group in an amount of 30 to 45% based on the total amount of an amide bond.

8. The photoreceptor of claim 1, wherein said N-alkylated polyamide copolymer comprises an alkyl group in an amount of 18 to 50% based on the total amount of an amide bond.

9. The photoreceptor of claim 1, wherein said N-alkylated polyamide copolymer comprises an alkyl group in an amount of 30 to 45% based on the total amount of an amide bond.

10. The photoreceptor of claim 1, wherein said undercoat layer contains said N-alkoxylated polyamide copolymer in an amount of 5 to 100% by weight.

11. The photoreceptor of claim 1, wherein said undercoat layer contains said N-alkylated polyamide copolymer in an amount of 5 to 100% by weight.

* * * * *